US007082988B2

(12) United States Patent
Yoshida et al.

(10) Patent No.: US 7,082,988 B2
(45) Date of Patent: Aug. 1, 2006

(54) HEAT EXCHANGER WITH HEAT DEFORMATION ABSORBING MECHANISM

(75) Inventors: Hiroyuki Yoshida, Sano (JP); Takaharu Gotou, Yokohama (JP)

(73) Assignees: Nissan Motor Co., Ltd., Yokohama (JP); Calsonic Kansei Corporation, Tokyo (JP)

( * ) Notice: Subject to any disclaimer, the term of this patent is extended or adjusted under 35 U.S.C. 154(b) by 219 days.

(21) Appl. No.: 10/475,554

(22) PCT Filed: Dec. 27, 2002

(86) PCT No.: PCT/JP02/13838

§ 371 (c)(1),
(2), (4) Date: Oct. 22, 2003

(87) PCT Pub. No.: WO03/067171

PCT Pub. Date: Aug. 14, 2003

(65) Prior Publication Data

US 2004/0182546 A1 Sep. 23, 2004

(30) Foreign Application Priority Data

Feb. 5, 2002 (JP) ..... 2002-028445

(51) Int. Cl.
*F28F 7/00* (2006.01)

(52) U.S. Cl. ..... 165/81; 165/166

(58) Field of Classification Search ..... 165/166, 165/81

See application file for complete search history.

(56) References Cited

U.S. PATENT DOCUMENTS 2,462,421 A * 2/1949 Pitt ..... 165/81
2,965,358 A * 12/1960 Behrens et al. ..... 165/82
3,228,461 A * 1/1966 Seekins ..... 165/81
3,294,159 A * 12/1966 Kovalik et al. ..... 165/81
3,889,744 A * 6/1975 Hill et al. ..... 165/83
3,891,396 A * 6/1975 Musall et al. ..... 422/179
3,939,908 A * 2/1976 Chartet ..... 165/149
4,090,358 A * 5/1978 Young ..... 165/81
4,582,126 A * 4/1986 Corey ..... 165/82
4,582,127 A * 4/1986 Moranne ..... 165/83
4,776,387 A 10/1988 Newman
4,805,695 A * 2/1989 Ishikawa et al. ..... 165/166
6,223,808 B1 * 5/2001 Tsunoda et al. ..... 165/82
6,328,099 B1 * 12/2001 Hilt et al. ..... 165/166

FOREIGN PATENT DOCUMENTS

EP 0 957 329 A1 11/1999

(Continued)

*Primary Examiner*—Teresa J. Walberg

(74) *Attorney, Agent, or Firm*—Foley & Lardner LLP

(57) ABSTRACT

A heat exchange section (1) composed of a fuel supply part (7); core (5), and steam collecting part (9). A heat exchange section (1) composed of the fuel supply part (7), core (5) and steam collecting part (9) is secured to a side wall plate (37). Three faces of the heat exchange section (1) except for the side wall plate side, high temperature gas inlet side and outlet side are covered by the housing body (43). Heat resistant filler (45), intervenes between the housing body (43) and the heat exchange section (1). An upper and lower portions (43*b*, 43*c*) of the housing body (43) are prevented from deforming due to thermal expansion of the core (1) by a heat deformation absorbing mechanism (47) which is formed by bending the joint of the flange (43*a*) of the housing body (43) and an upper and lower end portions (37*a*) of the side wall plate (37).

1 Claim, 11 Drawing Sheets

FOREIGN PATENT DOCUMENTS

| | | | |
|---|---|---|---|
| EP | 1 014 026 | A2 | 6/2000 |
| JP | 60-066098 | A | 4/1985 |
| JP | 60-89691 | A | 5/1985 |
| JP | 8-219671 | A | 8/1996 |
| JP | 9-273886 | A | 10/1997 |
| JP | 10-206067 | A | 8/1998 |

* cited by examiner

HEAT EXCHANGER WITH HEAT DEFORMATION ABSORBING MECHANISM

TECHNICAL FIELD

This invention relates to a heat exchanger which allows a heat exchange between a high temperature fluid and a low temperature fluid.

BACKGROUND OF THE INVENTION

In conventional heat exchangers, there have been several proposals to prevent a housing from deforming due to differences is thermal expansion between a core, composed of high temperature fluid channels and low temperature fluid channels, and a housing for accommodating the core (Japanese Patent Application Laid-open No. 9-273886, Japanese Patent Application Laid-open No. 10-206067, Japanese Patent Application Laid-open No. 8-219671).

SUMMARY OF THE INVENTION

However, the above-described heat exchangers are apt to cause deterioration in heat exchange efficiency. Further, it is troublesome to assemble the core and the housing because the seal function intervening between the core and the housing is complicated. Accordingly, it is conceivable to make use of a heat resistant filler intervening between a catalyst of a catalytic converter, as an exhaust emission control device of a vehicle, and a housing, because the heat resistant filler has a brief seal mechanism without causing deterioration in heat exchange.

FIGS. 1 to 3 show such a heat exchanger. FIG. 1 is a front view of the heat exchanger, FIG. 2 is a sectional view taken along the line 2—2 in FIG. 1, FIG. 3 is a plan view of the heat exchanger. This heat exchanger is provided with a heat exchange section 1 to allow heat exchange between a high temperature fluid and a low temperature fluid. The heat exchange section 1 is accommodated in a housing 3.

The heat exchange section 1 is provided with a core 5 in its central portion. A fuel supply part 7, into which fuel is supplied, is arranged on the lower portion of the core 5 in FIG. 2, and a steam collecting part 9, into which steam after the heat exchange of the supplied fuel collects, is arranged on the upper portion of the core 5 in FIG. 2.

The core 5 is provided with a high temperature fluid (high temperature gas) channel 21 and a low temperature fluid (fuel) channel 31 in FIG. 4. The high temperature fluid channel 21 is provided with a wave form fin 19 which is accommodated in the rectangular space defined by partition plates 11, 13 and an upper and lower end plates 15, 17. The low temperature fluid channel 31 is provided with a wave form fin 29 which is accommodated in the rectangular space defined by partition plates 13, 23 and right and left end plates 25, 27. These high and low temperature fluid channels 21, 31 are laminated one after the other.

The partition plates 13, 23 expand to the lower portion in FIG. 2. A through hole 33 is formed in the expanded portion of the partition plates 13, 23. The through holes 33 are to communicate the low temperature fluid channels 31 with each other for the fuel supply part 7. Similarly, the partition plates 13, 23 expand to the upper portion in FIG. 2. A through holes 35 are formed in the expanded portion of the partition plates 13, 23. Through holes 35 are to communicate the low temperature fluid channels 31 with each other for the steam collecting part 9.

In the above heat exchange section 1, the core 5 is secured to a side wall plate (cover member) 37 by welding or brazing. A fuel supply pipe 39 is connected to the side wall plate 37 at the portion corresponding to the fuel supply part 7. A steam discharge pipe 41 is connected to the side wall plate 37 at the portion corresponding with the steam collecting part 9.

The fuel is supplied from the fuel supply pipe 39 to the fuel supply part 7, vaporizing to be heated by the high temperature gas supplied to the high temperature fluid channel 21 of the core 5, and discharged outside from the steam discharge pipe 41 through the steam collecting part 9. After heat exchange, the high temperature gas is discharged from the opposite side.

The side wall plate 37 and a housing body 43 constitute the housing 3. The side wall plate 37 is secured to the housing body 43 at the upper and lower end portions 37*a* and to the flange 43*a* of the housing body 43 through welding, brazing or nuts and bolts.

The housing body 43 has openings 44 on the right and left sides in FIG. 1. These openings 44 serve as an inlet and outlet of the high temperature gas, respectively. A gas introduction duct and a gas discharge duct (not shown) are connected to the openings 44, respectively. Heat resistant filler 45 is filled up in the space defined by the housing body 43 and the heat exchange section 1. The heat resistant filler 45 is composed of an inorganic fiber such as glass wool and binder. The heat resistant filler 45 is substantially the same as the heat resistant filler intervening between a catalyst of a catalytic converter as an exhaust emission control device of a vehicle and a housing.

In the heat exchanger described above, the high temperature gas (300° C. to 800° C.) flowing into the heat exchange section 1 in operation concentrates in the central portion, due to the properties of fluids, so that the temperature in the central portion rises more than the temperature rises in the peripheral portion. Thus, the central portion of the heat exchange section 1 is apt to expand due to thermal expansion more than the peripheral portion. Due to thermal expansion, the upper and lower portions 43*b*, 43*c* of the housing body 43 are deformed so as to bulge outward, as shown by the two dotted lines in FIG. 2. Due to this deformation, the flange 43*a* leans inward and thus the side wall plate 37 also leans inward at its upper and lower end portions. Thus, the housing 3 is entirely deformed.

When the heat exchanger is not in operation, due to the fall in temperature, the lower and upper portions 43*b*, 43*c* of the housing body 43 deform so as to return to their original shape. The flange 43*a* and the side wall plate 37 also deform so as to return to their original shape. Thus, the deformation described above is repeated during the use of the heat exchanger, so that the durability of housing 3 composed of the housing body 43 and the side wall plate 37 deteriorates and strength of the joint of housing body 43 and the side wall plate 37 also deteriorates.

The above described phenomenon is apt to be marked at the inlet of the high temperature gas and not so noticeable at the outlet of the high temperature gas. Further, the side wall plate 37 expands due to variation of temperatures along flow direction of the high temperature gas, so that the durability of the side wall plate 37 is deteriorated.

Consequently, an object of the present invention is to prevent the durability of the housing accommodating the heat exchange section from deteriorating.

To achieve the object of the present invention, there is provided a heat exchanger comprising:

a heat exchange section having a core comprising a high temperature fluid channel in which high temperature fluid flows and a low temperature fluid channel in which low temperature fluid flows, wherein heat exchange between the high temperature fluid and the low temperature fluid is conducted;

a housing comprising a housing body having a first and a second planar wall and a third wall between said first and said second planar wall, said first and said second planar wall being substantially parallel to each other and each having a flanged portion extending outwardly along an end opposite to the third wall, and a cover member, covering the outside of the heat exchange section except for a high temperature fluid inlet side and outlet side, said cover member being joined at a periphery thereof to the flanged portions of said first planar wall and said second planar wall to form a first joint and a second joint;

a heat resistant filler intervening between the heat exchange section and the housing; and a heat deformation absorbing mechanism formed by bending at least one of the first joint or second joint substantially perpendicular to the cover member.

DETAILED DESCRIPTION OF EMBODIMENTS OF THE INVENTION

Now, with reference to FIG. 5, the first embodiment of the present invention will be described herein.

Figure 1:
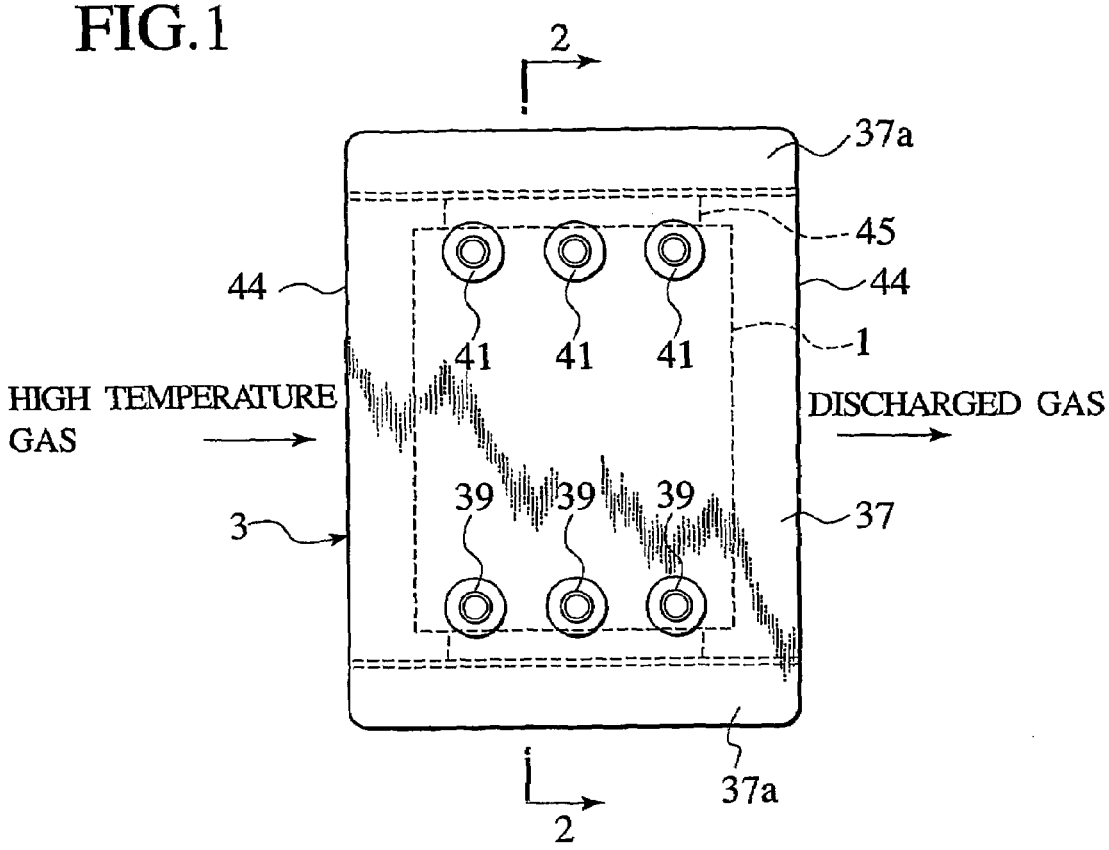
FIG. 1 is a front view of a proposed heat exchanger.
Figure 2:
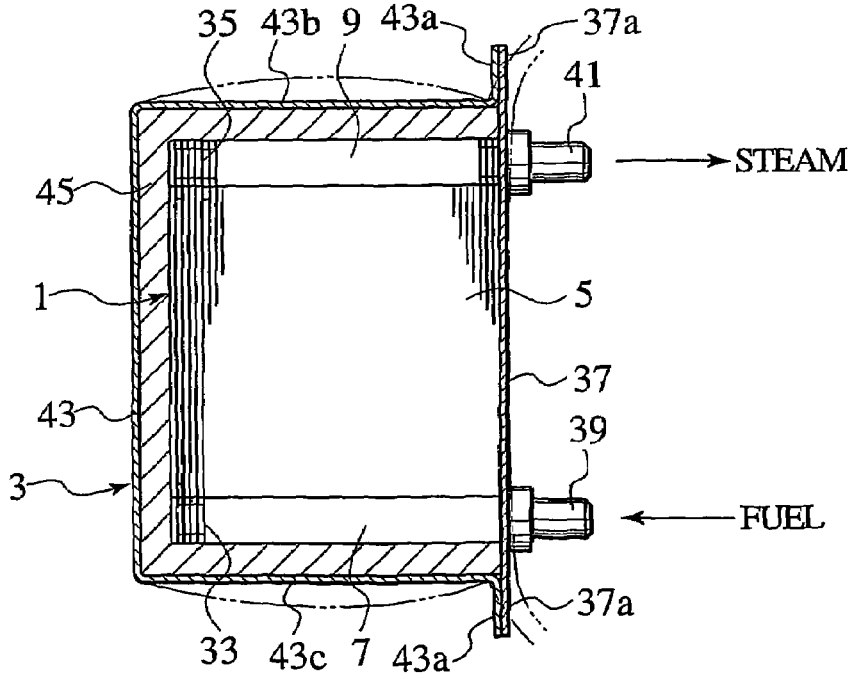
FIG. 2 is a cross sectional view taken along the line 2—2 in FIG. 1.
Figure 3:
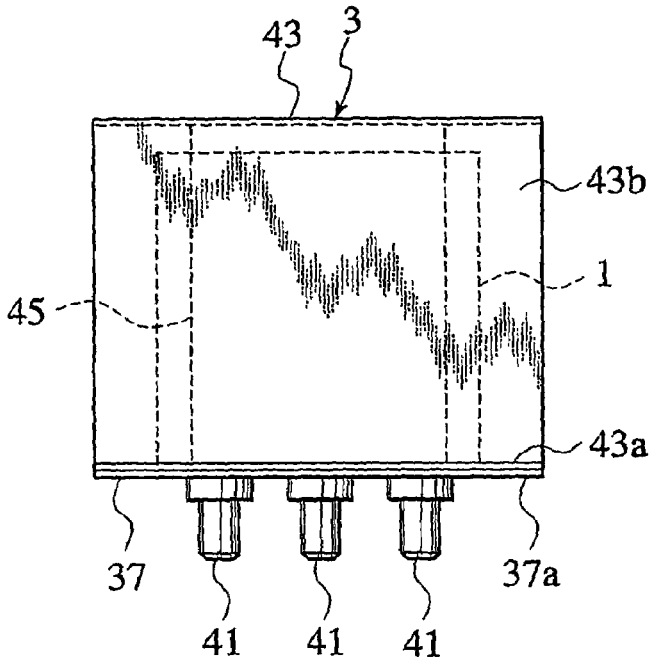
FIG. 3 is a plan view of the heat exchanger shown in FIG. 1.
Figure 4:
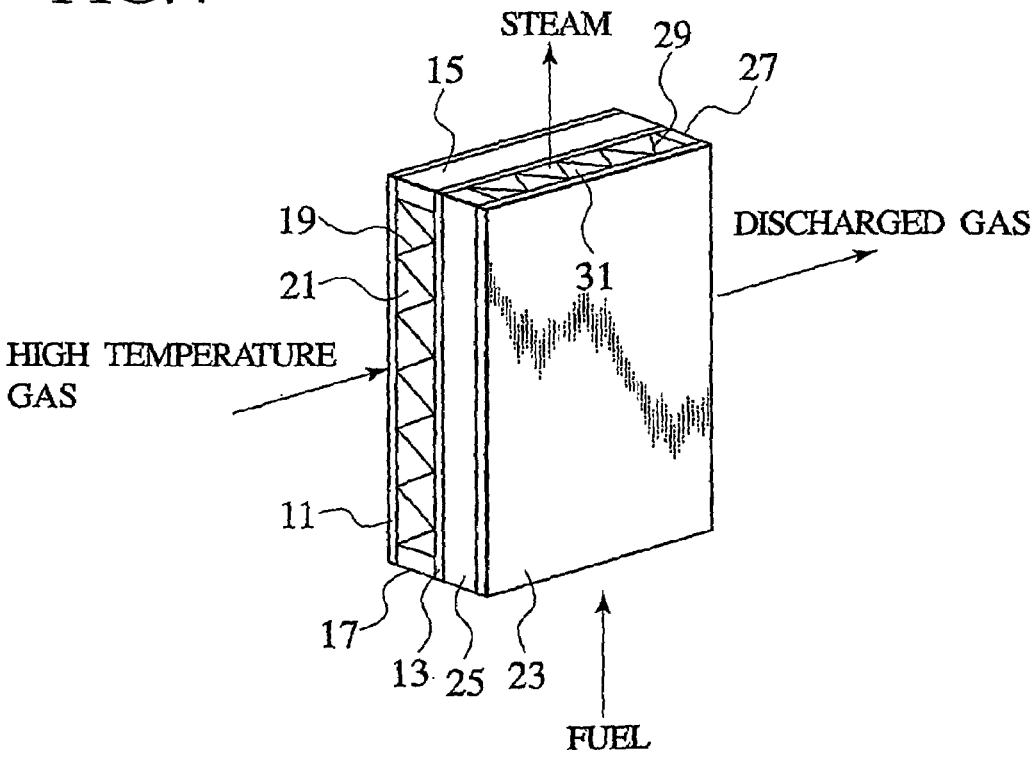
FIG. 4 is a perspective view of a part of the core of the heat exchanger shown in FIGS. 1 to 3.
Figure 5:
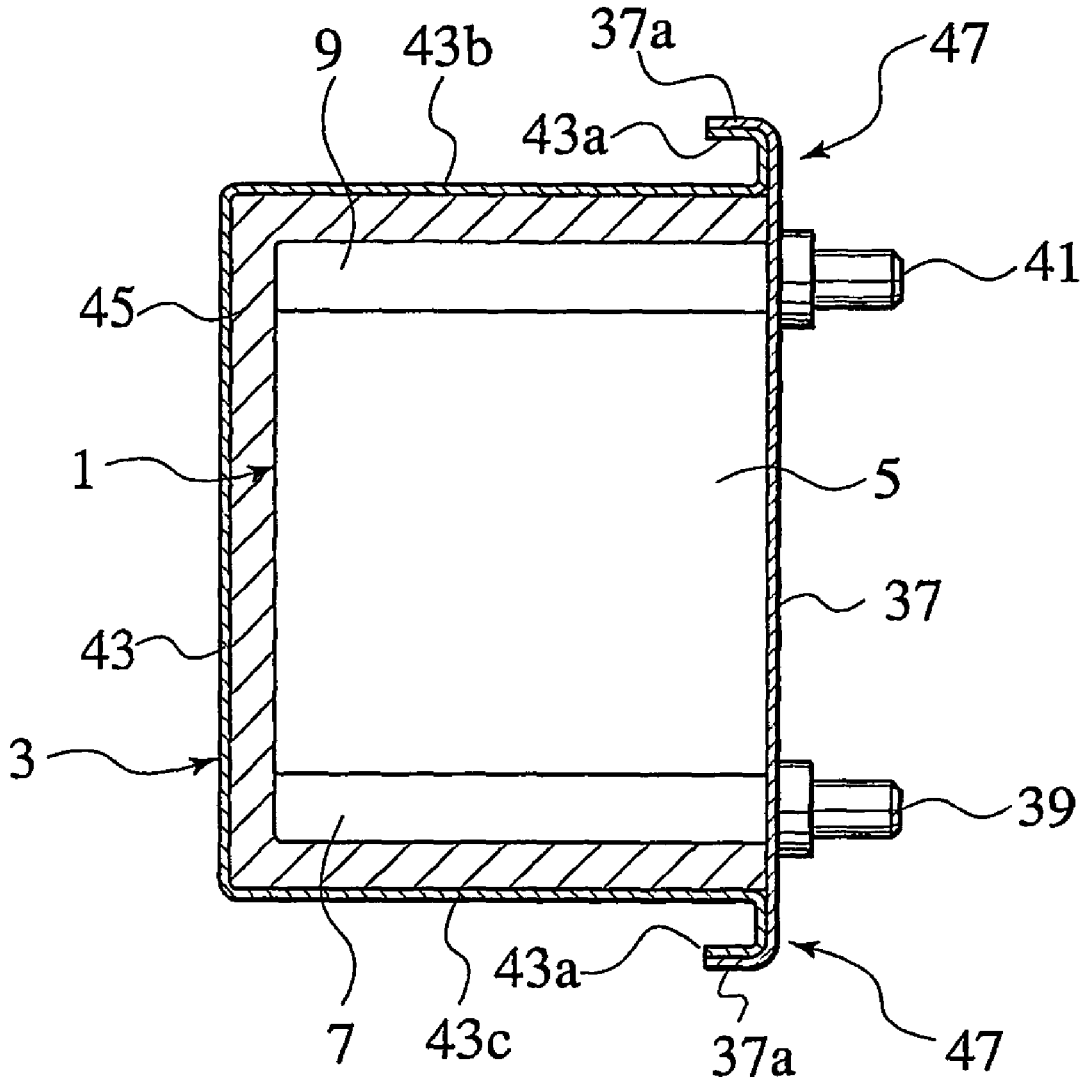
FIG. 5 is a cross sectional view of the first embodiment of the present invention, corresponding to FIG. 2.

FIG. 5 corresponds to FIG. 2 described above. In FIG. 5, redundant explanation is omitted by using like numbers for like members in FIGS. 1 to 4. In this embodiment, the flange 43*a* is bent at the middle portion outward with the upper and lower end portions 37*a* which is joined to the flange 43*a*. The flange 43*a* and the upper and lower end portions 37*a* are bent substantially parallel with the upper and lower portions 43*b*, 43*c* of the housing body 43 or substantially perpendicular to the side wall plate 37, to form a heat deformation absorbing mechanism 47.

The flange 43*a* and the upper and lower end portions 37*a* are joined at the heat deformation absorbing mechanism 47 by welding, brazing or nuts and bolts. Mainly, the flange 43*a* and the upper and lower end portions 37*a* are joined at the parallel portion of the heat deformation absorbing mechanism 47 with the upper and lower portions 43*b*, 43*c*.

In this heat exchanger, when high temperature gas flows in the high temperature fluid channel of the core 5, the heat exchange section 1 rises in temperature at its central portion more than its peripheral portions to produce thermal expansion. Due to this thermal expansion, the upper and lower portions 43*b*, 43*c* of the heat exchange section 1 are apt to bulge. However, the bulging force is suppressed by the heat deformation absorbing mechanism 47 composed of flange 43*a* and the upper and lower end portions 37*a*, so that the upper and lower portion portions 43*b*, 43*c* are prevented from deforming.

Since the deformation of the upper and lower portions 43*b*, 43*c* can be prevented, the joint strength of the heat deformation absorbing mechanism 47 can be secured and the deformation of the side wall plate 37 can be prevented, thus durability of the housing 3 can be improved.

Figure 6:
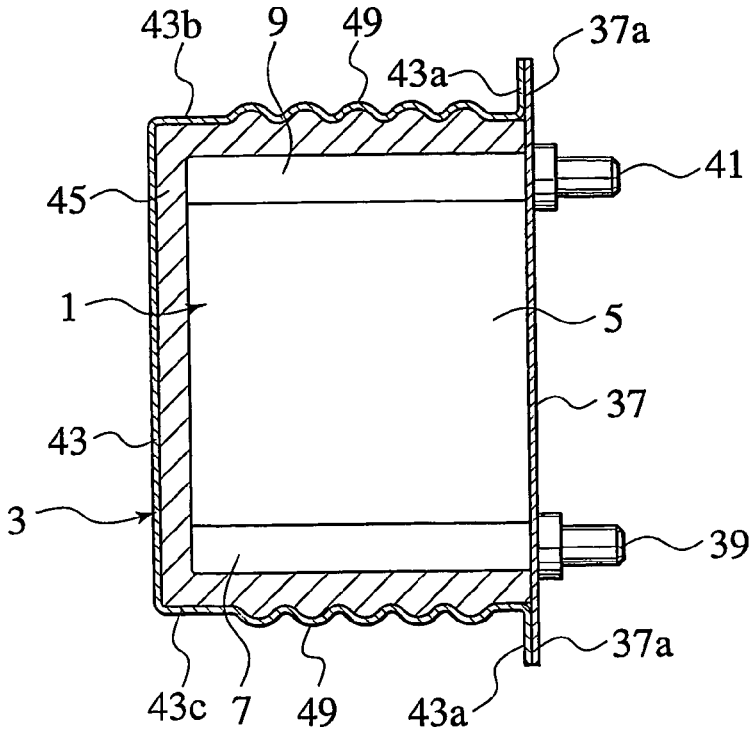
FIG. 6 is a cross sectional view of the second embodiment of the present invention, corresponding to FIG. 2.
Figure 7:
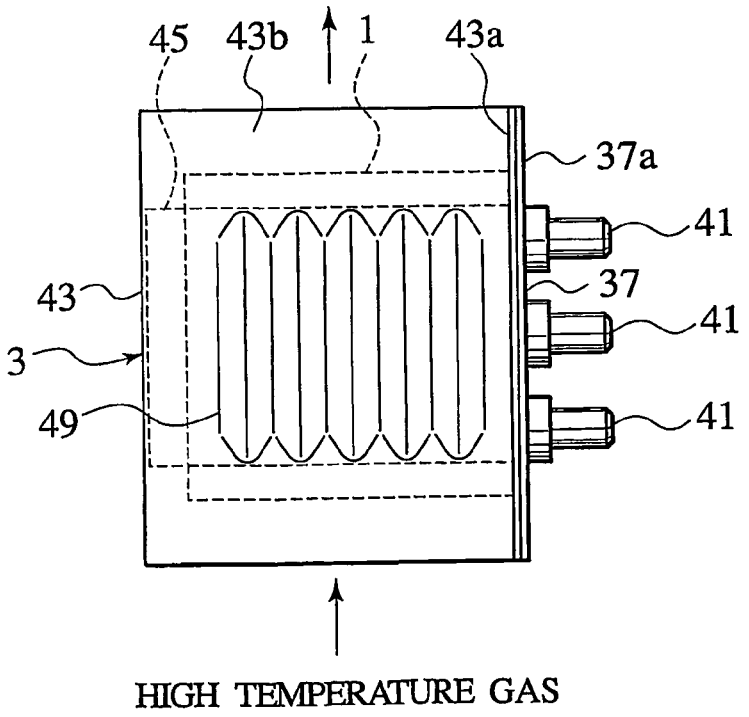
FIG. 7 is a plan view of the second embodiment of the present invention.

FIGS. 6 and 7 show the second embodiment of the present invention. FIG. 6 corresponds to FIG. 2 described above. In FIGS. 6 and 7, redundant explanation is omitted by using like numbers for like members in FIGS. 1 to 4. In this embodiment, a wave form portion 49 as a heat deformation absorbing mechanism is formed on the part of the upper and lower portions 43*b*, 43*c* of the housing body 43. The wave form portion 49 corresponds to the heat resistant filler 45.

The wave form portion 49 has a wave form of repeated projections and a recesses in rightward and leftward directions in FIGS. 6 and 7. The inner face of the recess is aligned with the inner face of the upper and lower portions 43*b*, 43*c*. Thus, it is easier to insert the heat exchange section 1 covered by the heat resistant filler 45 into the housing body 3. The arrangement described above can be changed in accordance with the elasticity of the heat resistant filler 45 and rigidity of the housing 3.

In the second embodiment, due to this thermal expansion, the heat exchange section 1 is apt to bulge the upper and lower portions 43*b*, 43*c*. However, the bulging force is absorbed by the elastic deformation of the wave form portion 49. Thus, the upper and lower portion portions 43*b*, 43*c* are prevented from deforming. Since the deformation of the upper and lower portions 43*b*, 43*c* can be prevented, the joint strength of the heat deformation absorbing mechanism 47 can be secured and the deformation of the side wall plate 37 can be prevented, thus durability of the housing 3 can be improved.

Figure 8:
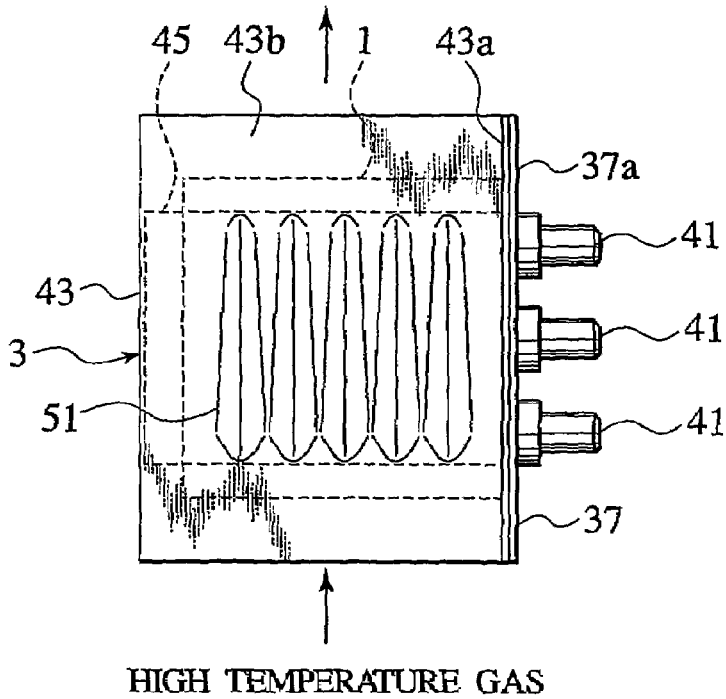
FIG. 8 is a plan view of the third embodiment of the present invention, corresponding to FIG. 7.

FIG. 8 shows the third embodiment of the present invention. FIG. 8 corresponds to FIG. 2 described above. An arrow in FIG. 8 designates the flow direction of high temperature gas. In FIG. 8, redundant explanation is omitted by using like numbers for like members in FIGS. 1 to 4. In this embodiment, a wave form portion 51 is provided instead of the wave form portion 49 described above. The wave form portion 51 has large projections and large recesses on the lower portion in FIG. 8 into which high temperature gas flows and small projections and small recesses on the upper portion in FIG. 8 from which high temperature gas flows. More concretely, the width or the height of the waves can be changed in the flow direction of high temperature gas. Only one of width and height may be changed.

The temperature on the inlet side of high temperature gas is higher than that on the outlet side of the high temperature gas. Accordingly, the thermal expansion on the inlet side of high temperature gas is larger than that on the outlet side of the high temperature gas. As described above, it is possible to deal with the thermal expansion in accordance with the temperature change by making the wave form portion 51 on the inlet side of high temperature gas larger. Thus, the deformation of the joint portion of flange 43*a* of the housing body 43 and the upper and lower end portions 37*a* of the side wall plate 37 and the deformation of the side wall plates 37 can be efficiently prevented. Thus, the joint strength of the joint portion can be secured, so that the durability of the housing 3 can be improved.

Figure 9:
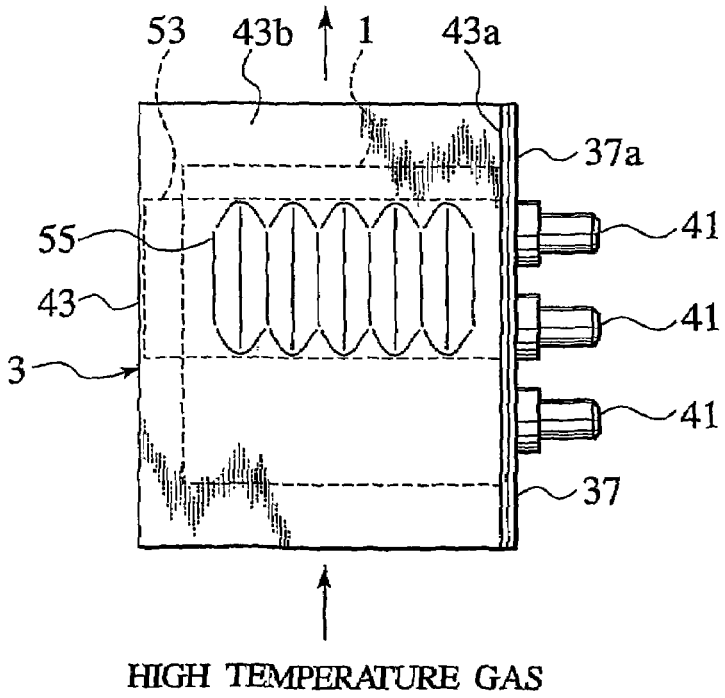
FIG. 9 is a plan view of the fourth embodiment of the present invention, corresponding to FIG. 7.

FIG. 9 shows the fourth embodiment of the present invention. FIG. 9 corresponds to FIG. 2 described above. In FIG. 9, redundant explanation is omitted by using like numbers for like members in FIGS. 1 to 4. In this embodiment, the heat resistant filler 53 has a short length in the flow direction of high temperature gas and arranged only on the downstream side of high temperature gas. A wave form portion 55 is formed on the part of the upper and lower portions 43*b*, 43*c* of the housing body 43. The wave form portion 55 is arranged in accordance with the heat resistant filler 53.

The temperature on the upstream side of high temperature gas is higher than that on the downstream side of the high temperature gas. Accordingly, the thermal expansion on the upstream side of high temperature gas is larger than that on the downstream side of the high temperature gas on which the heat resistant filler 55 is arranged. Thus,.the pressing force to the heat resistant filler 55 on the downstream side is smaller that that on the upstream side. Further, the bulging force to the upper and lower portion 43*b*, 43*c* of the housing body 43 on downstream side is smaller than that on the upstream side. The deformation of the upper and lower portions 43*b*, 43*c* of the housing body 43 can be effectively absorbed by arranging the heat resistant filler 53 on the downstream side. Thus, the deformation of the joint portion of flange 43*a* of the housing body 43 and the upper and lower end portions 37*a* of the side wall plate 37 and the deformation of the side wall plates 37 can be effectively prevented. Thus, the joint strength of the joint portion can be secured, so that the durability of the housing 3 can be improved.

Figure 10:
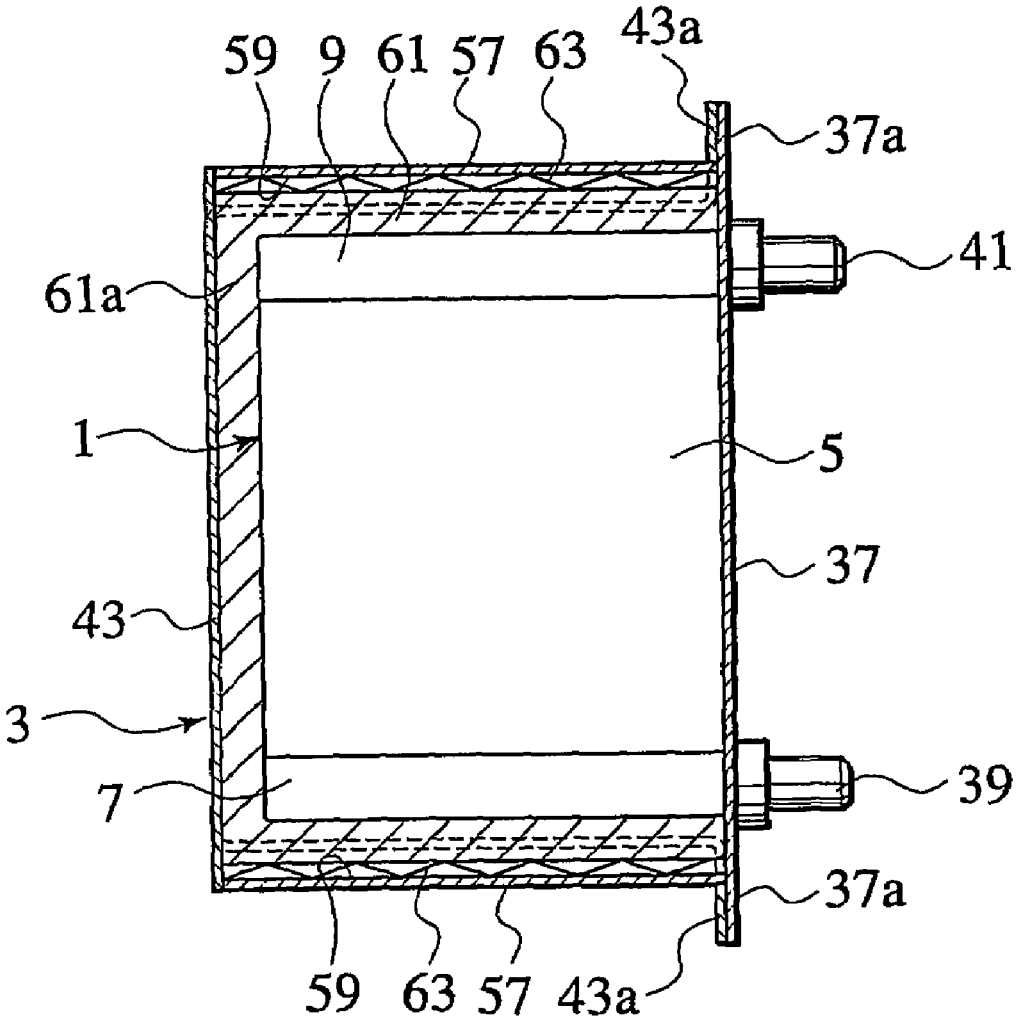
FIG. 10 is a cross sectional view of the fifth embodiment of the present invention, corresponding to FIG. 2.
Figure 11:
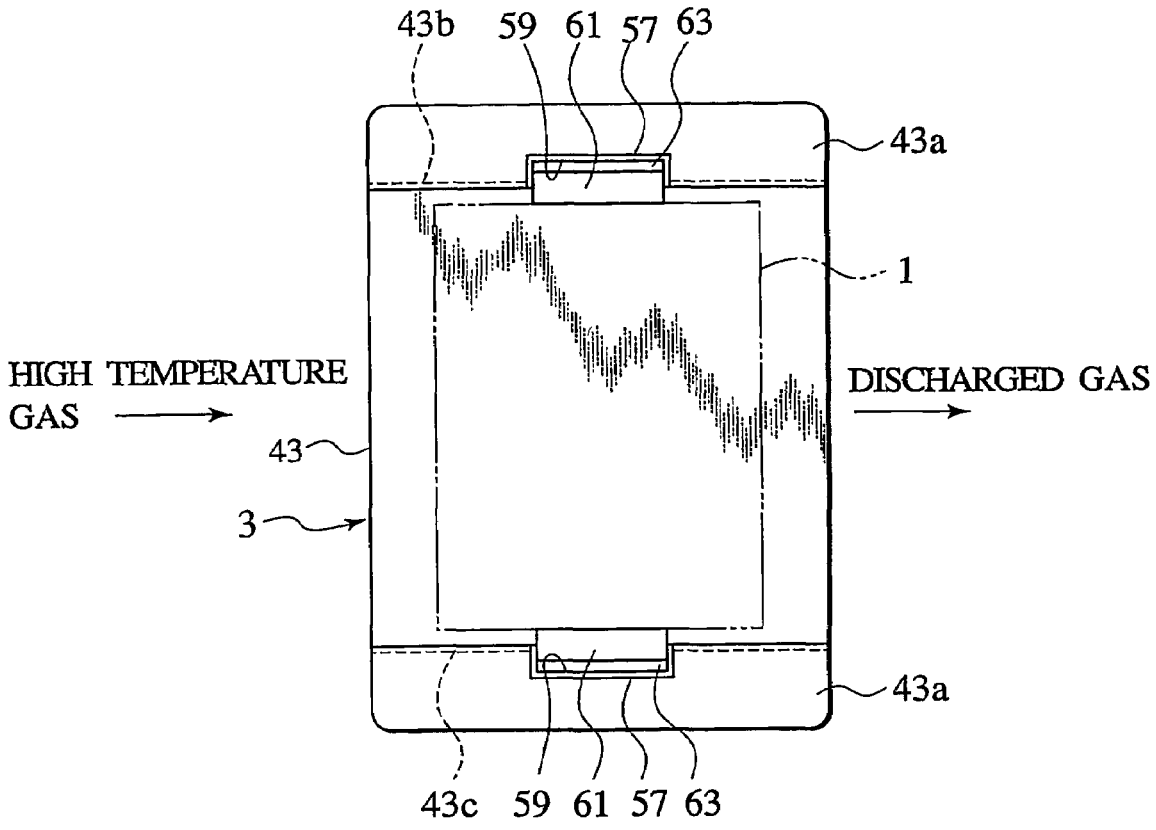
FIG. 11 is a view from the right side of FIG. 10, in which a side wall plate has been detached.

FIG. 10 shows the fifth embodiment of the present invention. FIG. 10 corresponds to FIG. 2 described above. In FIG. 10, redundant explanation is omitted by using like numbers for like members in FIGS. 1 to 4. FIG. 11 is a view from the right side of FIG. 10, in which a side wall plate has been removed. In this embodiment, a projection member 57 is provided on the central portion of the upper and lower portions 43*b*, 43*c* of the housing body in the flow direction of high temperature gas. The projection member 57 projects outward and extends over the whole width in the rightward and leftward direction in FIG. 10. The projection member 57 is composed of separate member and secured to the upper and lower portion 43*b*, 43*c* of the housing body 43 by welding or brazing.

The inside of the projection member 57 defines a filler accommodating portion 59 for accommodating a part of the heat resistant filler 61. A spring (elastic member) 63 intervenes between the heat resistant filler 61 and the bottom of the filler accommodating portion 59. The spring 63 is composed of a waved plate having elasticity. The elastic force of the spring 36 is smaller than that of the heat resistant filler 61.

The filler accommodating portion 59 and spring 63 constitute a heat deformation absorbing mechanism. The part 61a of the heat resistant filler 61 corresponding to the side wall plate 37 may have the same thickness as the part of the heat resistant filler 61 accommodated in the filler accommodating portion 59 or may have larger thickness than that of the part of the heat resistant filler 61 accommodated in the filler accommodating portion 59. Further, the spring 63 is not limited to a wave form and may take other forms.

In this embodiment, due to the thermal expansion of the heat exchange section, the heat resistant filler 61 is pressed. However, this pressing force is absorbed by the elastic deformation of the spring 63, and thus the deformation of the upper and lower portion of the housing body 43 is suppressed. Thus, the deformation of the joint portion of the flange 43*a* of the housing body 43 and the upper and lower end portions 37*a* of the side wall plate 37 and the deformation of the side wall plates 37 can be effectively prevented. Thus, the joint strength of the joint portion can be secured, so that the durability of the housing 3 can be improved.

Further, since the heat resistant filler 61 is pressed to the heat exchange section 1 by the spring 63, seal properties against the high temperature gas can be improved. Further, by appropriately changing the depth of the filler accommodating portion 59 and the elasticity of the spring 63, material for the heat exchange section 1 and the housing 3 can be changed easily, thus improves flexibility in selection of materials.

Figure 12:
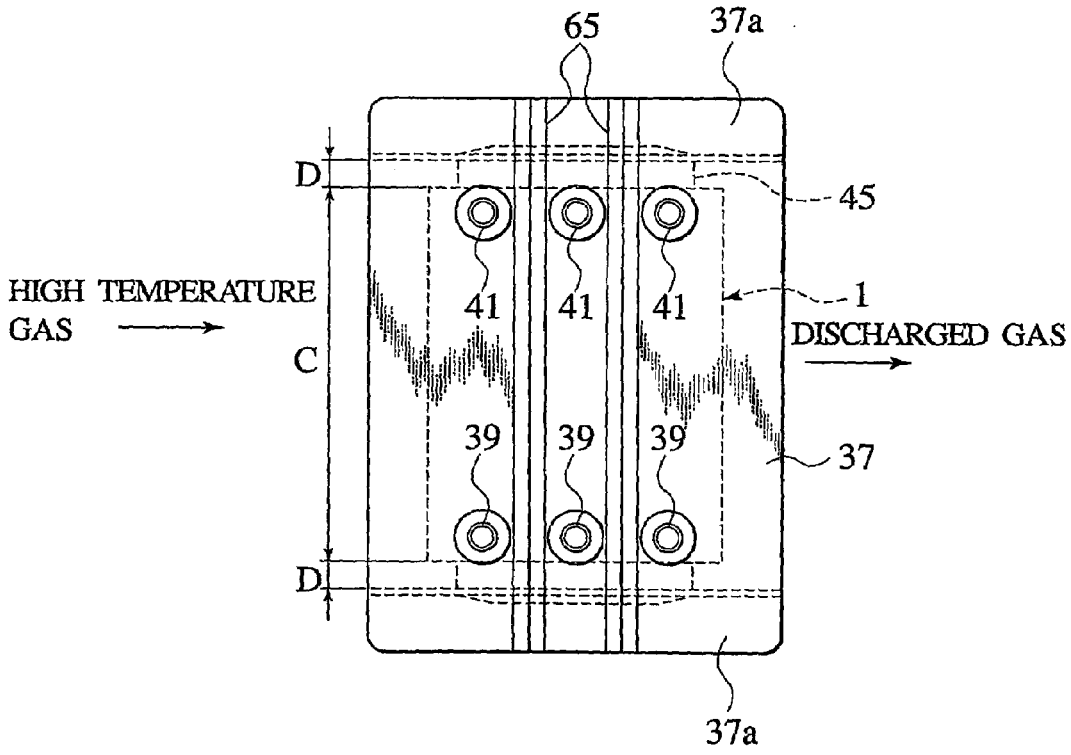
FIG. 12 is a front view of the sixth embodiment of the present invention, corresponding to FIG. 1.
Figure 13:
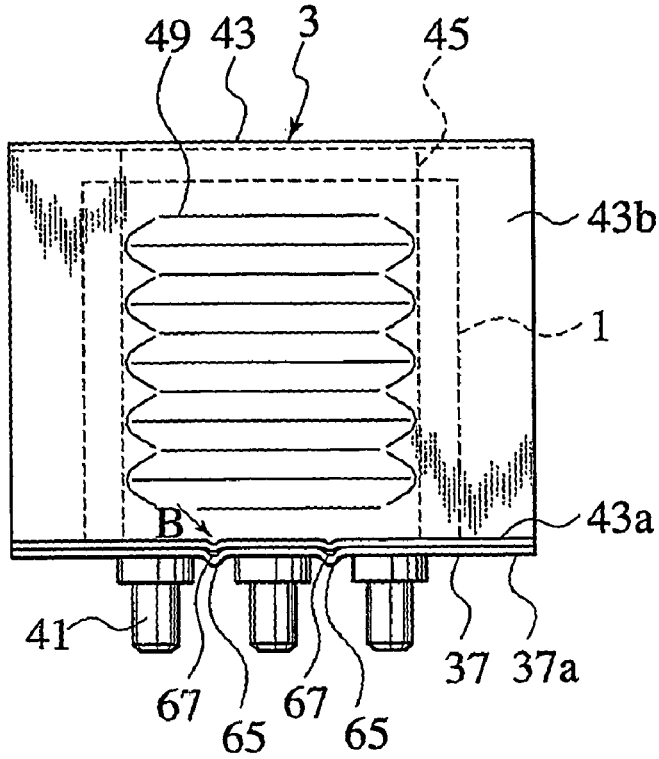
FIG. 13 is a plan view of FIG. 12.

FIG. 12 shows the sixth embodiment of the present invention. FIG. 12 corresponds to FIG. 1 described above. In FIG. 12, redundant explanation is omitted by using like numbers for like members in FIGS. 1 to 4. FIG. 13 is a plan view of FIG. 12. In this embodiment, two protrusions 65 (first protrusion) (heat deformation absorbing mechanism) extending in the vertical direction of FIG. 12 and perpendicularly to the flow direction of the high temperature gas are formed on the central portion of the side wall plate 37 in rightward and leftward directions in FIG. 12. The protrusion 65 is formed on the area of the side wall plate 37 corresponding to the heat resistant filler 45 in the flow direction of the high temperature gas, and extends from the upper end portion 37*a* to lower end portion 37*a*. As shown in FIG. 13, the protrusion 65 projects outward from the heat exchange section 1. The flange 43*a* of the housing body 43 corresponding to the upper and lower end portion 37*a* is formed with protrusion (second protrusion) 67 corresponding to protrusion 65.

Figure 14:
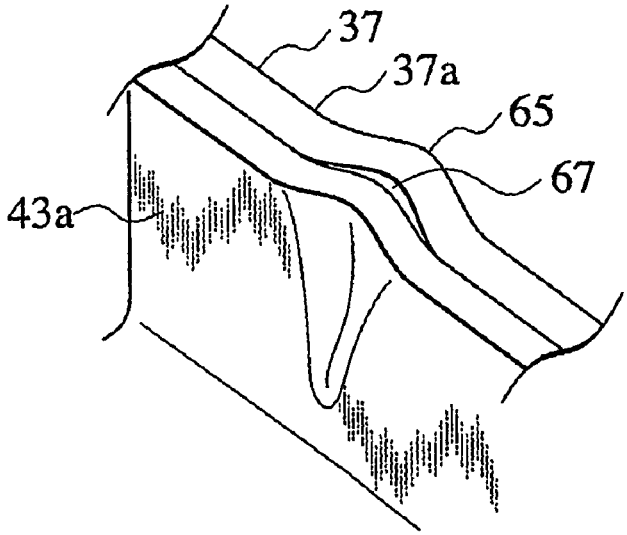
FIG. 14 is a partially enlarged view of the part designated by arrow B in FIG. 13.

FIG. 14 is a partially enlarged view of the part designated with arrow B in FIG. 13. As shown in FIG. 14, the protrusion 67 formed in the flange 43*a* of the housing body 43 projects into the recess formed in the upper and lower end portions 37*a* of the side wall plate 37.

The upper and lower portion 43*b*, 43*c* of the housing body is formed with the wave form portion 49 similar to that in the second embodiment shown in FIGS. 6 and 7.

In the embodiment shown in FIGS. 12 to 14, the protrusions 65, 67 absorb the deformation of the side wall plate 37 due to difference in thermal expansion of the heat exchange section 1 caused by difference in temperature along the flow direction of high temperature gas. Thus, the deformation of the joint portion of flange 43*a* of the housing body 43 and the upper and lower end portions 37*a* of the side wall plate 37 and the deformation of the side wall plates 37 can be effectively prevented. Further, as in the second embodiment, the wave form portion 49 with its deformation absorbs the thermal expansion of the heat exchange section 1 in a vertical direction in FIG. 12.

In addition, the side wall plate 37 is formed with protrusion 65, so that the side wall plate 37 is formed with grooves on the inner face thereof opposite to the heat exchange section 1. However, since the area C of the side wall plate 37 opposite to the core 5 in FIG. 12 is joined airtightly to the core 5 by brazing, and the area D of the side wall plate 37 opposite to the heat resistant filler 45 in FIG. 12 is filled with the heat resistant filler 45 in the groove, gas leaks from the groove can be prevented.

Figure 15:
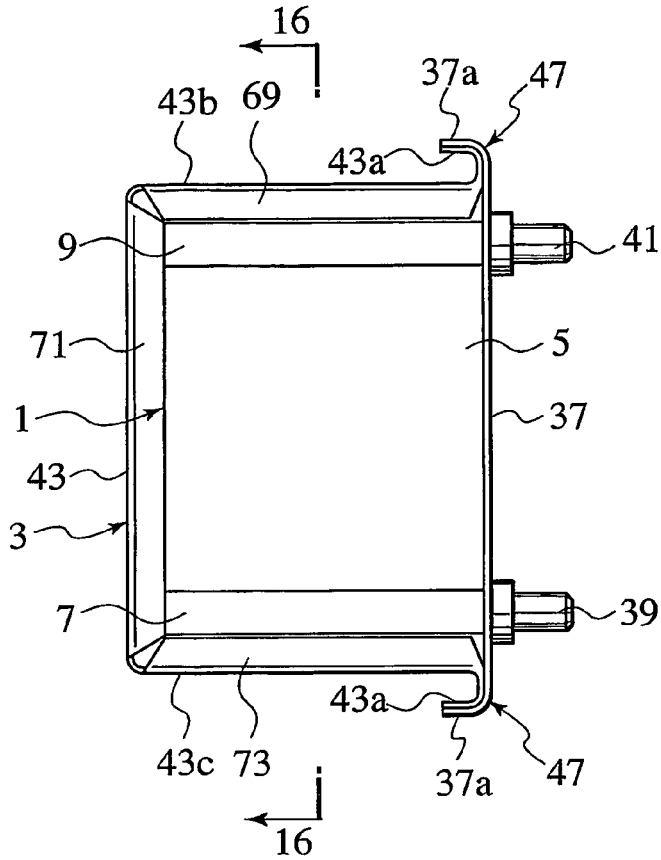
FIG. 15 is a side view of the seventh embodiment of the present invention, from the high temperature gas inlet side of the heat exchanger.
Figure 16:
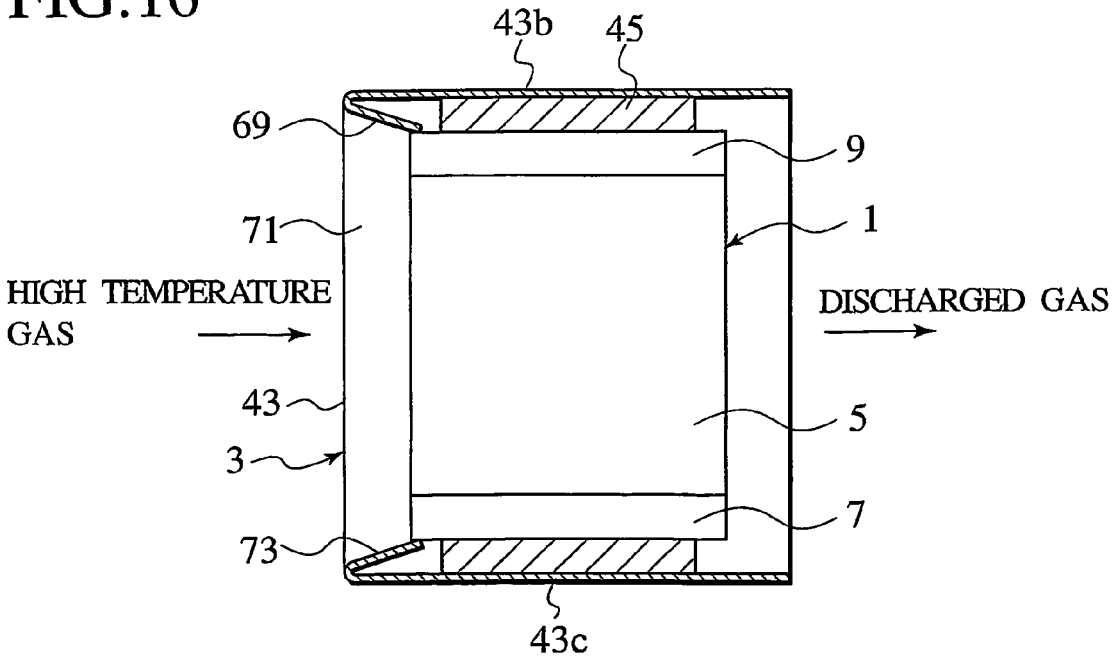
FIG. 16 is a cross sectional view taken along the line 16—16 in FIG. 15.

FIG. 15 shows the seventh embodiment of the present invention. FIG. 15 corresponds to FIG. 2 described above and is a view from the high temperature inlet side. In FIG. 15, redundant explanation is omitted by using like numbers for like members in FIGS. 1 to 4. FIG. 16 is a cross sectional view taken along the line 16—16 in FIG. 15. In this embodiment, the heat resistant filler 45 is prevented from being subjected to high temperature gas, and further, the heat deformation absorbing mechanism described in the above embodiment is provided on the heat exchanger, thus the deformation of the housing 3 is securely suppressed. In this embodiment, a heat deformation absorbing mechanism 47 which is the same as that of the first embodiment is adopted.

Figure 17:
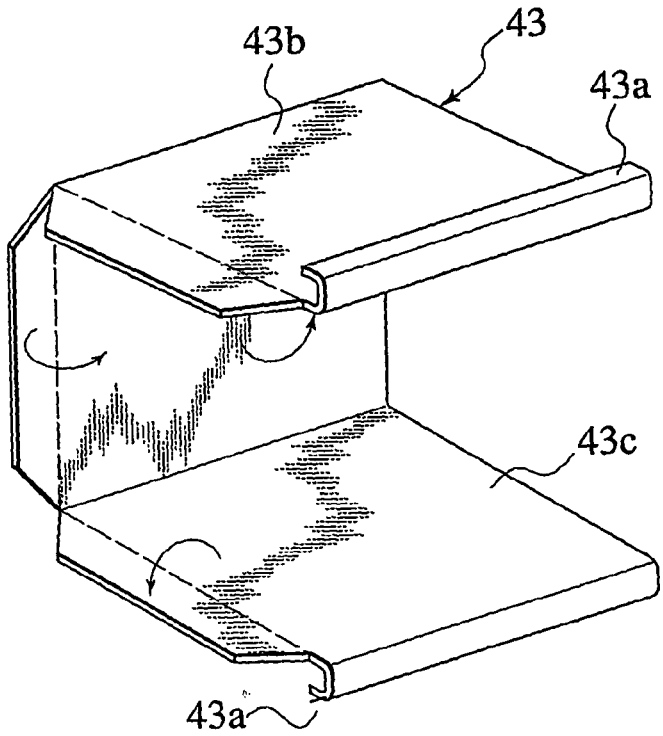
FIG. 17 is a perspective view of the housing body in which a folded portion of FIG. 15 is not formed.
Figure 18:
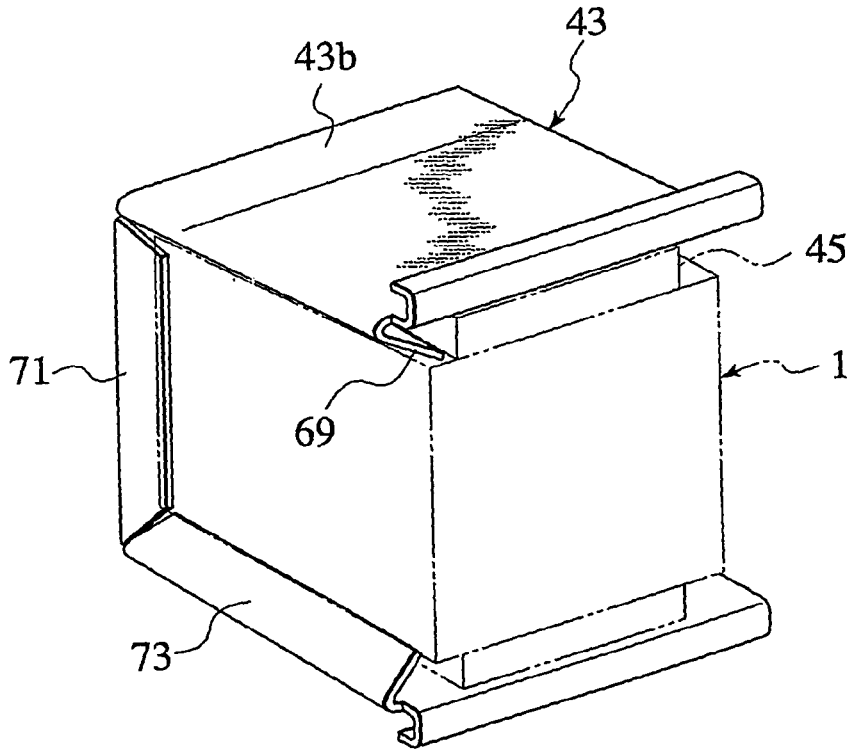
FIG. 18 is a perspective view of the housing body in which a folded portion of FIG. 15 is not formed.

The three peripheral portions of the housing body 43 on the high temperature gas inlet side are folded inside to form folded portions 69, 71, 73. The distal end of the folded portions 69, 71, 73 abut against the outer periphery of the heat exchange section 1. The rest of the structure is the same as that of the first embodiment. FIG. 17 shows a perspective view of the housing body in which the folded portions 69, 71, 73 are not formed yet. FIG. 18 shows a perspective view of the housing body in which the folded portions 69, 71, 73 have been formed.

With the seventh embodiment, the high temperature gas flowed into the heat exchanger from left side in FIG. 16 is restricted from directly flowing into the heat resistant filler 45 by the folded portions 69, 71, 73. The heat resistant filler 45, composed of inorganic fiber such as glass wool and binder, is not directly subjected to the high temperature gas (300° C. to 800° C.) and receives heat through heat exchange section 1. Thus, the heat resistant filler 45 is subjected to heat of a lower temperature by several tens of degrees centigrade to several hundreds of degrees centigrade lower than that of the high temperature gas, so that deterioration and change in quality of the heat resistant filler 45 can be effectively prevented. Especially, when a generation device for the high temperature gas is a burner, fire is effectively restricted from entering into the heat resistant filler 45.

As the result, the housing 43 can be securely prevented from deforming with the heat deformation absorbing mechanism 47.

Japanese Patent Application No. 2002-28445 is expressly incorporated herein by reference in its entirety.

INDUSTRIAL APPLICABILITY

The heat exchanger of the present invention comprises a heat deformation absorbing mechanism absorbing heat deformation produced in the core due to the flow of the high temperature fluid. The upper and lower portions are prevented from deforming by the heat deformation absorbing mechanism. Thus, the durability of the housing accommodating the heat exchange section from deteriorating.

The invention claimed is:

1. A heat exchanger comprising:

a heat exchange section having a core comprising a high temperature fluid channel in which a high temperature fluid flows and a low temperature fluid channel in which a low temperature fluid flows, wherein a heat exchange between the high temperature fluid and the low temperature fluid is conducted;

a housing comprising a housing body having a first and a second planar wall and a third wall between said first and said second planar wall, said first and said second planar wall being substantially parallel to each other and each having a flanged portion extending outwardly along an end opposite to the third wall, and a cover member, covering the outside of the heat exchange section except for a high temperature fluid inlet side and outlet side, said cover member being joined at a periphery thereof to the flanged portions of said first planar wall and said second planar wall to form a first joint and a second joint, respectively; and a heat resistant filler intervening between the heat exchange section and the housing; and a heat deformation absorbing mechanism formed by bending at least one of the first joint or second joint substantially perpendicular to the cover member.

* * * * *